US012467324B2

(12) United States Patent
Rowe et al.

(10) Patent No.: US 12,467,324 B2
(45) Date of Patent: Nov. 11, 2025

(54) PROCESS HEATER ANTI-SETTLING SYSTEMS AND METHODS

(71) Applicant: Halliburton Energy Services, Inc., Houston, TX (US)

(72) Inventors: Mathew Dennis Rowe, Spring, TX (US); Shaun Patrick Lawrence, Houston, TX (US); Michael S. Bittar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 614 days.

(21) Appl. No.: 17/745,195

(22) Filed: May 16, 2022

(65) Prior Publication Data

US 2022/0403708 A1 Dec. 22, 2022

Related U.S. Application Data

(60) Provisional application No. 63/212,385, filed on Jun. 18, 2021.

(51) Int. Cl.

| | |
|---|---|
| ***E21B 21/06*** | (2006.01) |
| ***E21B 21/10*** | (2006.01) |
| ***E21B 36/00*** | (2006.01) |

(52) U.S. Cl.

CPC ..... *E21B 21/065* (2013.01); *E21B 21/063* (2013.01); *E21B 21/067* (2013.01); (Continued)

(58) Field of Classification Search

None

See application file for complete search history.

(56) References Cited

U.S. PATENT DOCUMENTS 4,492,862 A 1/1985 Grynberg et al.
4,887,464 A 12/1989 Tannenbaum et al.
(Continued)

FOREIGN PATENT DOCUMENTS

EP 3182119 A1 6/2017
GB 2619622 12/2023
(Continued)

OTHER PUBLICATIONS

"PCT Application No. PCT/US2022/029765, International Preliminary Report on Patentability", Dec. 28, 2023, 8 pages.
(Continued)

*Primary Examiner* — Levon J Shahinian

(74) *Attorney, Agent, or Firm* — DeLizio, Peacock, Lewin & Guerra, LLP

(57) ABSTRACT

The disclosure provides for systems and methods for removing particle settlement in a heater system. The method includes introducing a fluid into a first heater of the heater system, wherein the first heater is operable to increase the temperature of the introduced fluid. The method further includes actuating a first air agitation unit to discharge a volume of compressed air into the first heater, wherein the compressed air is configured to provide mixing and suspension to particles settled within the first heater through the velocity and expansion of the compressed air to atmospheric pressure. The method further includes discharging a mixture from the first heater comprising the fluid and the particles from the first heater and directing the discharged mixture to a return point in a flow path.

14 Claims, 8 Drawing Sheets

(52) U.S. Cl.
CPC ..... *E21B 21/106* (2013.01); *E21B 36/00* (2013.01); *E21B 36/006* (2013.01)

(56) References Cited

U.S. PATENT DOCUMENTS

| | | | |
|---|---|---|---|
| 5,199,509 | A | 4/1993 | Wright et al. |
| 7,392,138 | B2 | 6/2008 | Frechin et al. |
| 7,465,426 | B2 | 12/2008 | Kerherve et al. |
| 7,520,166 | B2 | 4/2009 | Frechin et al. |
| 7,748,266 | B2 | 7/2010 | Evrard et al. |
| 8,011,238 | B2 | 9/2011 | Hanson |
| 8,561,718 | B2 | 10/2013 | Calleri |
| 8,899,348 | B2 | 12/2014 | Henderson et al. |
| 8,939,021 | B2 | 1/2015 | Daniel et al. |
| 9,341,606 | B2 | 5/2016 | Coleman et al. |
| 9,671,381 | B2 | 6/2017 | Karoum et al. |
| 9,765,617 | B2 | 9/2017 | Gosney et al. |
| 10,180,062 | B2 | 1/2019 | Pickell et al. |
| 10,371,691 | B2 | 8/2019 | Strapoc et al. |
| 2010/0163080 | A1 | 7/2010 | Lofton et al. |
| 2013/0242688 | A1 | 9/2013 | Kageler |
| 2014/0311707 | A1 | 10/2014 | Wiebe et al. |
| 2016/0084023 | A1 | 3/2016 | Calleri |
| 2018/0023356 | A1 | 1/2018 | Ochoa |

FOREIGN PATENT DOCUMENTS

| | | | |
|---|---|---|---|
| KR | 1020170031279 | | 3/2017 |
| WO | WO2004027208 | A1 | 4/2004 |
| WO | 2009090351 | A1 | 7/2009 |
| WO | WO2010081981 | A2 | 7/2010 |
| WO | WO2017067641 | A1 | 4/2017 |
| WO | WO2017076490 | A1 | 5/2017 |
| WO | WO2020185094 | A1 | 9/2020 |
| WO | 2022265795 | | 12/2022 |

OTHER PUBLICATIONS

"PCT Application No. PCT/US2022/029765 International Search Report and Written Opinion", Sep. 6, 2022, 9 pages.

PROCESS HEATER ANTI-SETTLING SYSTEMS AND METHODS

CROSS-REFERENCE TO RELATED APPLICATION

The present application claims benefit of U.S. Provisional Application No. 63/212,385 filed Jun. 18, 2021, which is incorporated herein by reference in its entirety for all purposes.

TECHNICAL FIELD OF THE INVENTION

The present disclosure relates generally to air and acoustic mixing to maintain process heater performance with drilling fluids.

BACKGROUND

Heaters processing drilling fluid may fail due to particles settling during operations. The ability to clean the heater increases time between failures, but it does not address the fundamental problem of low superficial velocity that holds particles in suspension.

Figure 1:
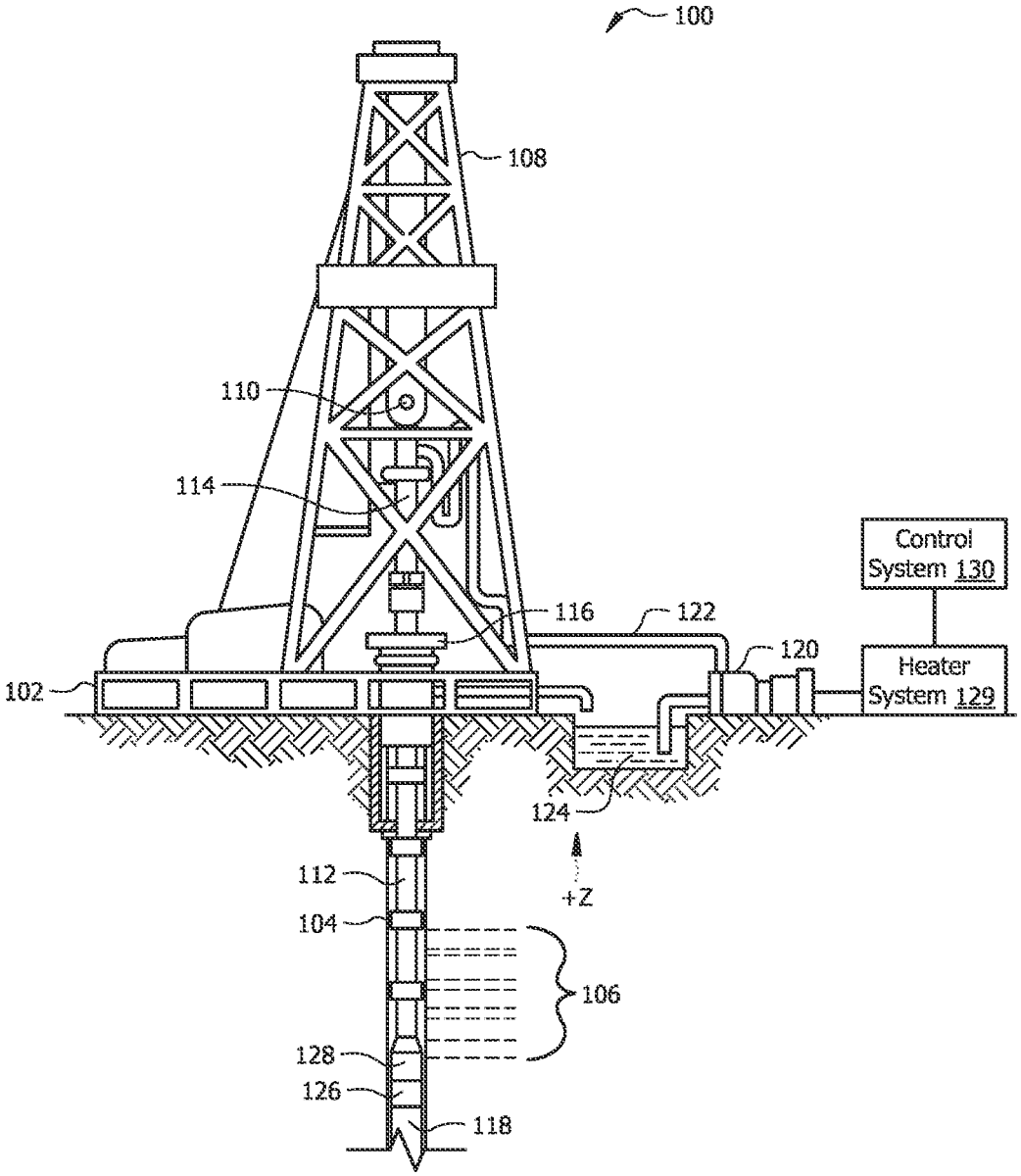
FIG. 1 is a schematic diagram of a drilling system at a well site, according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "1*a*" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the disclosure. Embodiments described below with respect to one implementation are not intended to be limiting.

For purposes of this disclosure, a control system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, a control system may be a personal computer, a network storage device, or any other suitable device and may vary in size, shape, performance, functionality, and price. The control system may include random access memory (RAM), one or more processing resources such as a central processing unit (CPU) or hardware or software control logic, ROM, and/or other types of nonvolatile memory. Additional components of the control system may include one or more disk drives, one or more network ports for communication with external devices as well as various input and output (I/O) devices, such as a keyboard, a mouse, and a video display. The control system may also include one or more buses operable to transmit communications between the various hardware components. The control system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The terms "couple" or "couples," as used herein, are intended to mean either an indirect or direct connection. Thus, if a first device couples to a second device, that connection may be through a direct connection, or through an indirect electrical connection or a shaft coupling via other devices and connections.

The present disclosure provides for systems and methods for the removal of particle settlement in a heater system. In embodiments, heaters processing a drilling fluid may fail due to particles settling during operations. Cleaning the heater increases time between failures, but it does not address the issue of low-superficial velocity that holds particles in suspension. Further, cleaning the heaters requires downtime in operations at the wellsite. In embodiments, the periodic introduction of compressed air at defined intervals, or when a specific condition is met, increases the velocity and mixing in a heater to remove suspended particles and prevents caking due to settling within the heater.

FIG. 1 is a schematic diagram of an exemplary drilling system 100 that may employ the principles of the present disclosure, according to one or more embodiments. As illustrated, the drilling system 100 may include a drilling platform 102 positioned at the surface and a wellbore 104 that extends from the drilling platform 102 into one or more subterranean formations 106. In other embodiments, such as in an offshore drilling operation, a volume of water may separate the drilling platform 102 and the wellbore 104. Even though FIG. 1 depicts a land-based drilling platform 102, it will be appreciated that the embodiments of the present disclosure are equally well suited for use in other types of drilling platforms, such as offshore platforms, or rigs used in any other geographical locations. The present disclosure contemplates that wellbore 104 may be vertical, horizontal or at any deviation.

The drilling system 100 may include a derrick 108 supported by the drilling platform 102 and having a traveling block 110 for raising and lowering a conveyance 112, such as a drill string. A kelly 114 may support the conveyance 112 as it is lowered through a rotary table 116. In one or more embodiments, a top drive (not shown) may be used in place of the kelly 114 and rotary table 116. A drill bit 118 may be coupled to the conveyance 112 and driven by a downhole motor and/or by rotation of the conveyance 112 by the rotary table 116. As the drill bit 118 rotates, it creates the wellbore 104, which penetrates the subterranean formations 106. A pump 120 may circulate drilling fluid through a feed pipe 122 and the kelly 114, downhole through the interior of conveyance 112, through orifices in the drill bit 118, back to the surface via the annulus defined around conveyance 112, and into a retention pit 124. The drilling fluid cools the drill bit 118 during operation and transports cuttings from the wellbore 104 into the retention pit 124.

The drilling system 100 may further include a heater system 129 disposed near the derrick 108 and fluidly coupled to the retention pit 124, pump 120, and/or feed pipe 122. In embodiments, the heater system 129 may be operable to increase a temperature of a fluid before and/or after introduction into the wellbore 104.

The drilling system 100 may further include a bottom hole assembly (BHA) 126 coupled to the conveyance 112 near the drill bit 118. The BHA 126 may comprise various downhole measurement tools such as, but not limited to, measurement-while-drilling (MWD) and logging-while-drilling (LWD) tools, which may be configured to take downhole measurements of drilling conditions.

As the drill bit 118 extends the wellbore 104 through the formations 106, the BHA 126 may continuously or intermittently transmit signals and receive back signals relating to a parameter of the formations 106, for example, impulse signals such as Wicker wavelet, Blackman pulse or its higher order time derivatives, as well as chirp signals, etc. The BHA 126 may be communicably coupled to a telemetry module 128 used to transfer measurements and signals from the BHA 126 to a surface receiver (not shown) and/or to receive commands from the surface receiver. The telemetry module 128 may encompass any known means of downhole communication including, but not limited to, a mud pulse telemetry system, an acoustic telemetry system, a wired communications system, a wireless communications system, or any combination thereof. In certain embodiments, some or all of the measurements taken at the BHA 126 may also be stored within the BHA 126 or the telemetry module 128 for later retrieval at the surface upon retracting the conveyance 112.

As illustrated, a control system 130 for controlling, processing, and/or storing data for the heater system 129 may be included in the drilling system 100. The control system 130 may be communicably coupled to the heater system 129 by way of a wired or wireless connection. In one or more embodiments, the control system 130 may be disposed about any suitable location in the drilling system 100. In alternate embodiments, control system 130 may be located remotely from the system 100. The control system 130 may be directly or indirectly coupled to any one or more components of the drilling system 100.

Figure 2:
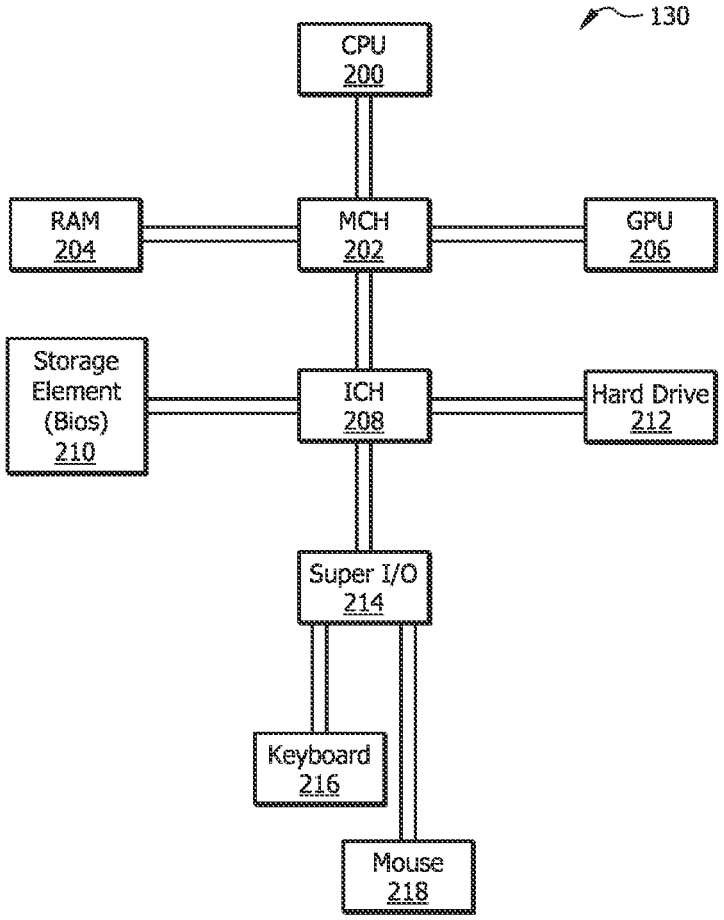
FIG. 2 is a diagram illustrating an example control system, according to aspects of the present disclosure.

FIG. 2 is a diagram illustrating an example control system 130, according to aspects of the present disclosure. A processor or central processing unit (CPU) 200 of the control system 130 is communicatively coupled to a memory controller hub or north bridge 202. The processor 200 may include, for example a microprocessor, microcontroller, digital signal processor (DSP), application specific integrated circuit (ASIC), or any other digital or analog circuitry configured to interpret and/or execute program instructions and/or process data. Processor 200 may be configured to interpret and/or execute program instructions or other data retrieved and stored in any memory such as memory 204 or hard drive 212. Program instructions or other data may constitute portions of a software or application for carrying out one or more methods described herein. Memory 204 may include read-only memory (ROM), random access memory (RAM), solid state memory, or disk-based memory. Each memory module may include any system, device or apparatus configured to retain program instructions and/or data for a period of time (e.g., computer-readable non-transitory media). For example, instructions from a software or application may be retrieved and stored in memory 204 for execution by processor 200.

Modifications, additions, or omissions may be made to FIG. 2 without departing from the scope of the present disclosure. For example, FIG. 2 shows a particular configuration of components of control system 130. However, any suitable configurations of components may be used. For example, components of control system 130 may be implemented either as physical or logical components. Furthermore, in some embodiments, functionality associated with components of control system 130 may be implemented in special purpose circuits or components. In other embodiments, functionality associated with components of control system 130 may be implemented in configurable general-purpose circuit or components. For example, components of control system 130 may be implemented by configured computer program instructions.

Memory controller hub (MCH) 202 may include a memory controller for directing information to or from various system memory components within the control system 130, such as memory 204, storage element 210, and hard drive 212. The memory controller hub 202 may be coupled to memory 204 and a graphics processing unit (GPU) 206. Memory controller hub 202 may also be coupled to an I/O controller hub (ICH) or south bridge 208. I/O controller hub 208 is coupled to storage elements of the control system 130, including a storage element 210, which may comprise a flash ROM that includes a basic input/output system (BIOS) of the computer system. I/O controller hub 208 is also coupled to the hard drive 212 of the control system 130. I/O controller hub 208 may also be coupled to a Super I/O chip 214, which is itself coupled to several of the I/O ports of the computer system, including keyboard 216 and mouse 218.

In certain embodiments, the control system 130 may comprise at least a processor and a memory device coupled to the processor that contains a set of instructions that when executed cause the processor to perform certain actions. In any embodiment, the control system 130 may include a non-transitory computer readable medium that stores one or more instructions where the one or more instructions when executed cause the processor to perform certain actions. As used herein, a control system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, a control system may be a computer terminal, a network storage device, or any other suitable device and may vary in size, shape, performance, functionality, and price. The control system 130 may include random access memory (RAM), one or more processing resources such as a central processing unit (CPU) or hardware or software control logic, read only memory (ROM), and/or other types of nonvolatile memory. Additional components of the control system 130 may include one or more disk drives, one or more network ports for communication with external devices as well as various input and output (I/O) devices, such as a keyboard, a mouse, and a video display. The control system 130 may also include one or more buses operable to transmit communications between the various hardware components.

Figure 3:
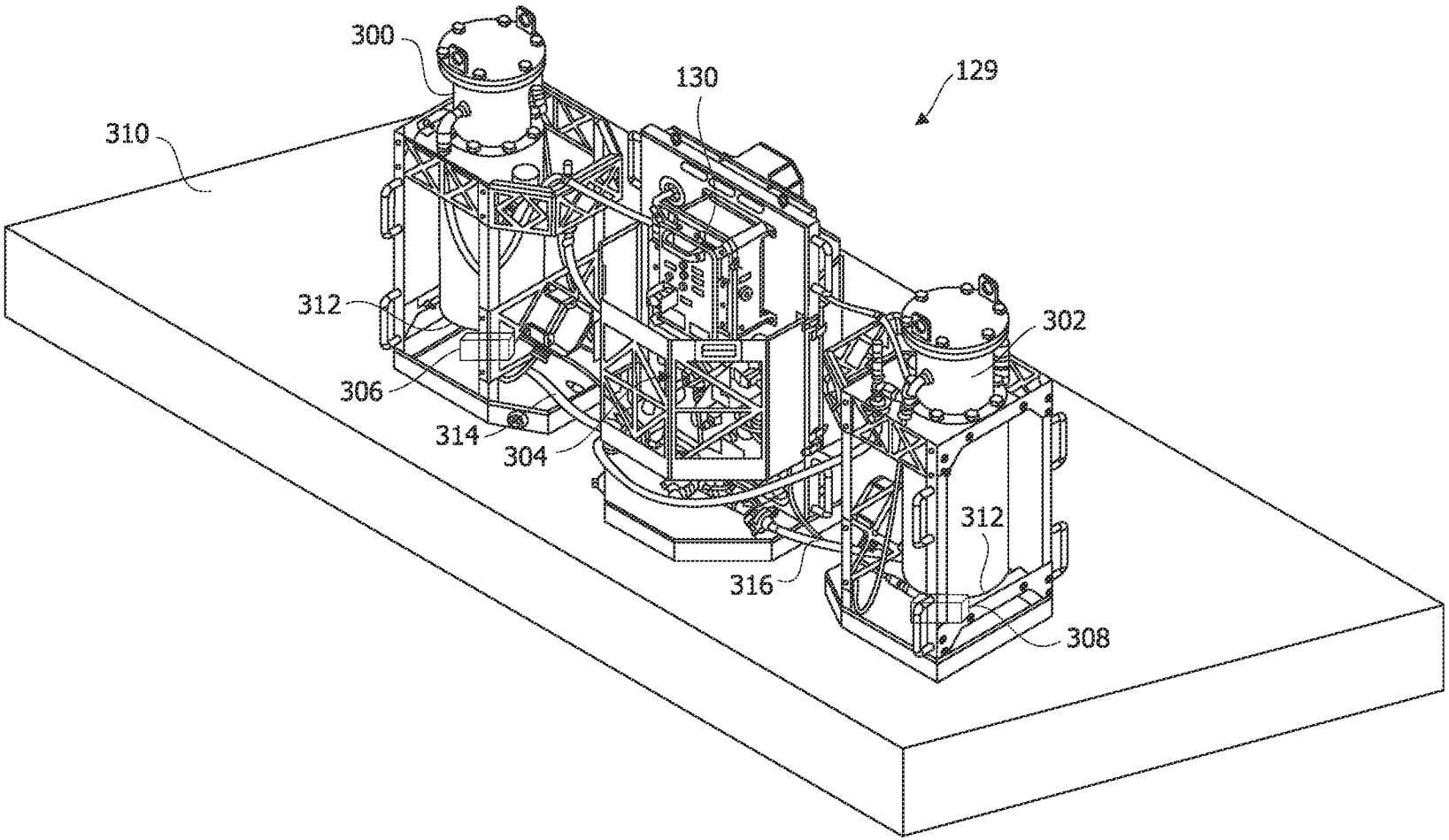
FIG. 3 is a diagram illustrating an example heater system, according to aspects of the present disclosure.
Figure 4:
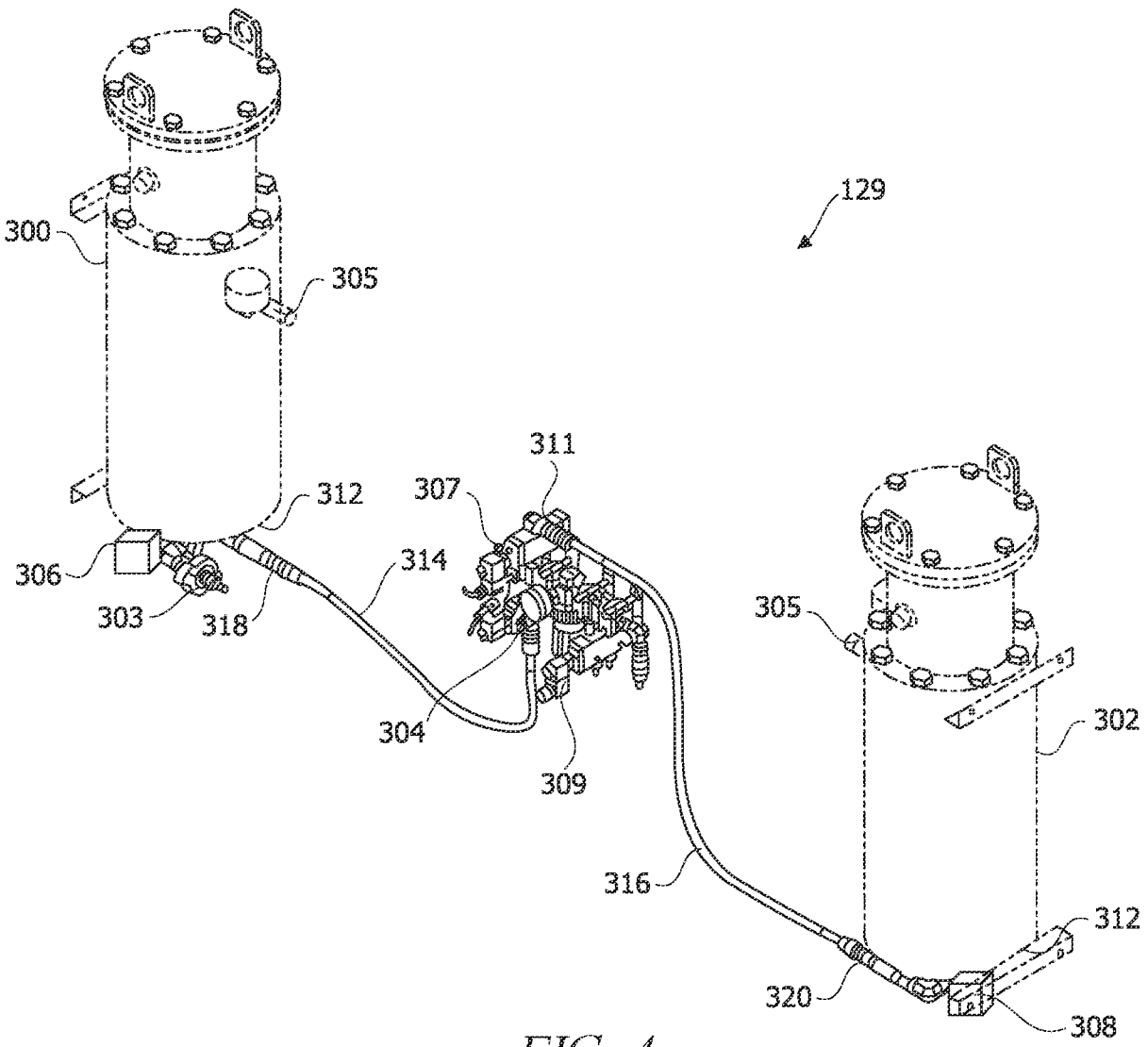
FIG. 4 is a diagram illustrating the heater system of FIG. 3, according to one or more aspects of the present disclosure.
Figure 5:
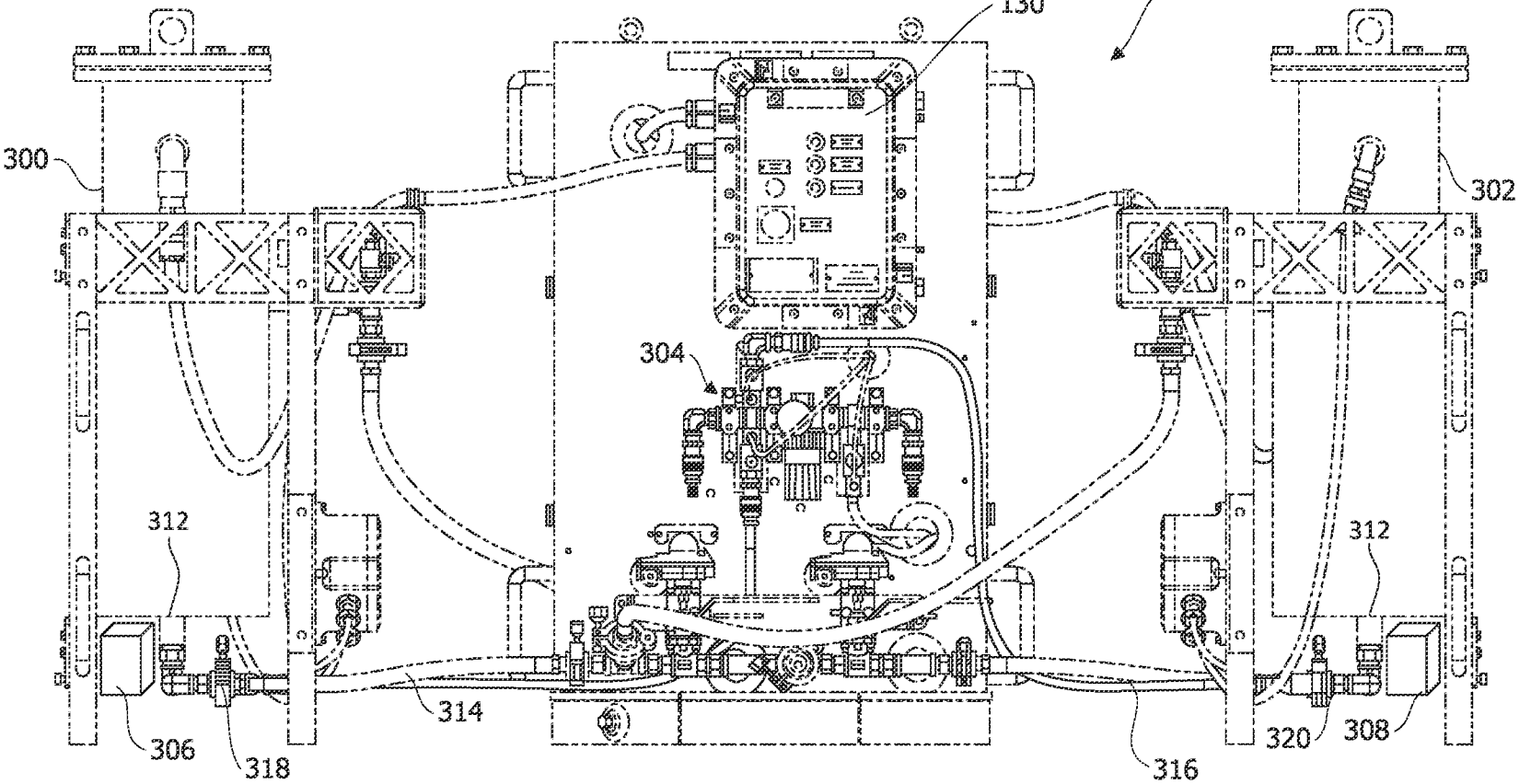
FIG. 5 is a diagram illustrating the heater system of FIG. 3, according to one or more aspects of the present disclosure.

FIGS. 3-5 are diagrams illustrating an example heater system 129. The heater system 129 may comprise any suitable equipment, sensors, electronics, and the like operable to perform one or more operations to increase a temperature of a fluid. As illustrated, the heater system 129 may comprise a first heater 300, a second heater 302, at least one air agitation unit 304, a first acoustic device 306, a second acoustic device 308, and the control system 130. Each component of the heater system 129 may be disposed on a skid 310 (as best seen on FIG. 3). The skid 310 may be any suitable size, height, shape, and any combinations thereof. Further, the skid 310 may comprise any suitable materials, such as metals, nonmetals, polymers, composites, and any combinations thereof. The skid 310 may be operable to contain and/or transport any sensors, equipment, circuitry, and the like of the heater system 129. In one or more embodiments, the skid 310 may be incorporated as part of the drilling platform 102 (referring to FIG. 1).

As illustrated, the first heater 300 and second heater 302 may be disposed on the skid 310. Each of the first heater 300 and second heater 302 may be disposed at any suitable location on the skid 310 and/or in relation to each other. Each of the first heater 300 and second heater 302 may be any suitable size, height, length, shape, and any combination thereof. Each of the first heater 300 and second heater 302 may be operable to increase a temperature of a fluid introduced therein. Each of the first heater 300 and second heater 302 may comprise a fluid inlet 303 and a fluid outlet 305 (as best seen on the first heater 300 in FIG. 4). The fluid inlet 303 may be operable to introduce a suitable fluid, such as a drilling fluid, into the heater 300, 302. The fluid outlet 305 may be operable to discharge a suitable fluid, such as a drilling fluid, out of the heater 300, 302 at an increased temperature. Both the fluid inlet 303 and fluid outlet 305 may be disposed about any suitable location along the first and second heaters 300, 302. In embodiments, each of the first heater 300 and second heater 302 may be any suitable heating device. Both the first heater 300 and the second heater 302 may be the same type of heating device or may be different from each other. Without limitations, the first heater 300 and second heater 302 may each be a cast heater, commercial heater, immersion heater, and the like. In embodiments, the at least one air agitation unit 304 may be disposed in between and coupled to both the first heater 300 and the second heater 302.

The at least one air agitation unit 304 may be any suitable size, height, length, shape, and any combination thereof. The at least one air agitation unit 304 may be operable to generate and discharge a volume of compressed air into the first heater 300 and/or into the second heater 302. In embodiments, the at least one air agitation unit 304 may be any suitable device or collection of equipment operable to produce compressed air. Without limitations, the at least one air agitation unit 304 may be a 5-way/2-position pilot solenoid valve. The at least one air agitation unit 304 may comprise an air regulator 307, and air manifold 309, and an air solenoid 311 (as best seen on FIG. 4). The air regulator 307 may be configured to reduce the air pressure supplied by the drilling system 100 and/or the at least one air agitation unit 304. The reduction may be from between about 60 psig to about 120 psig to from about 10 psig to about 40 psig. The air manifold 309 may be configured to direct air to different air-operated devices. The air solenoid 311 may be an on/off switch for blow-back and vibrate functionality.

During operations, the at least one air agitation unit 304 may be configured to introduce the discharged, compressed air into a bottom end 312 of each of the first heater 300 and second heater 302. By introducing through the bottom end 312, the compressed air may facilitate mixing and suspension for particles settled in the entirety of the fluid within the first heater 300 and/or second heater 302 through the velocity and expansion of the compressed air to atmospheric pressure. In one or more embodiments, the at least one air agitation unit 304 may be coupled to the first heater 300 and/or second heater 302 at a different location other than the bottom end 312. As illustrated, a first flow line 314 may couple the at least one air agitation unit 304 to the bottom end 312 of the first heater 300, and a second flow line 316 may couple the at least one air agitation unit 304 to the bottom end 312 of the first heater 302. A first check valve 318 may be disposed along the first flow line 314, and a second check valve 320 may be disposed along the second flow line 316. Both the first and second check valves 318, 320 may be operable to allow a flow of fluid in one direction. For example, the first check valve 318 may allow a flow of compressed air to flow from the at least one agitation unit 304 to the first heater 300 and not in an opposite direction, and the second check valve 320 may allow a flow of compressed air to flow from the at least one agitation unit 304 to the second heater 302 and not in an opposite direction.

In one or more embodiments, the first acoustic device 306 and the second acoustic device 308 may be included in the heater system 129. In other embodiments, the heater system 129 may not include the first acoustic device 306 and the second acoustic device 308. The first acoustic device 306 and the second acoustic device 308 may be any suitable device or collection of equipment operable to generate and direct an acoustic wave. In embodiments, the first acoustic device 306 and the second acoustic device 308 operate at a power level low enough to avoid fluid cavitation, but powerful enough to agitate the fluid and heating elements within heaters 300, 302 to maintain particle suspension. Without limitations, the first acoustic device 306 and the second acoustic device 308 may be an ultrasonic device, acoustic emitting device, and the like. As illustrated, the first acoustic device 306 may be disposed underneath the bottom end 312 of the first heater 300. In other embodiments, the first acoustic device 306 may be coupled to the bottom end 312 of the first heater 300. Similarly, the second acoustic device 308 may be disposed underneath or coupled to the bottom end 312 of the second heater 302. Both the first acoustic device 306 and the second acoustic device 308 may be operable to discharge a generated acoustic wave upwards towards and through the first heater 300 and second heater 302, respectively.

In embodiments, the control system 130 may be disposed in proximity to the first heater 300, second heater 302, and the at least one air agitation unit 304. The control system 130 may be a dedicated information handling system operable to control the heater system 129 and/or the drilling system 100 (referring to FIG. 1). The control system 130 may be operable to control the the first heater 300, second heater 302, the at least one air agitation unit 304, the first acoustic device 306, the second acoustic device 308, and any combination thereof. During operations, the control system 130 may actuate the at least one air agitation unit 304 to generate a burst of compressed air for a period of time. The period of time may last for any suitable amount of time, selected from a range such as from about 1 second to about 5 seconds, about 5 seconds, to about 10 seconds, or greater than about 10 seconds. The compressed air may be generated at a suitable pressure. Without limitations, the suitable pressure may be selected from a range of about 5 psi to about 10 psi, from about 10 psi to about 20 psi, from about 20 psi to about 30 psi, or greater than about 30 psi. The control system 130 may be operable to actuate the at least one air agitation unit 304 according to a determined schedule, such as periodically at about 30 minutes, about 60 minutes, about 120 minutes, about 150 minutes, or any other suitable time. In one or more embodiments, the control system 130 may actuate the at least one air agitation unit 304 during an operational condition in addition to or in place of periodic actuation. Without limitations, the at least one air agitation unit 304 may be actuated when the heater system 129 is flushed of fluids for cleaning, when there is a period of time lacking operations at the drilling system 100, or a combination thereof.

Figure 6:
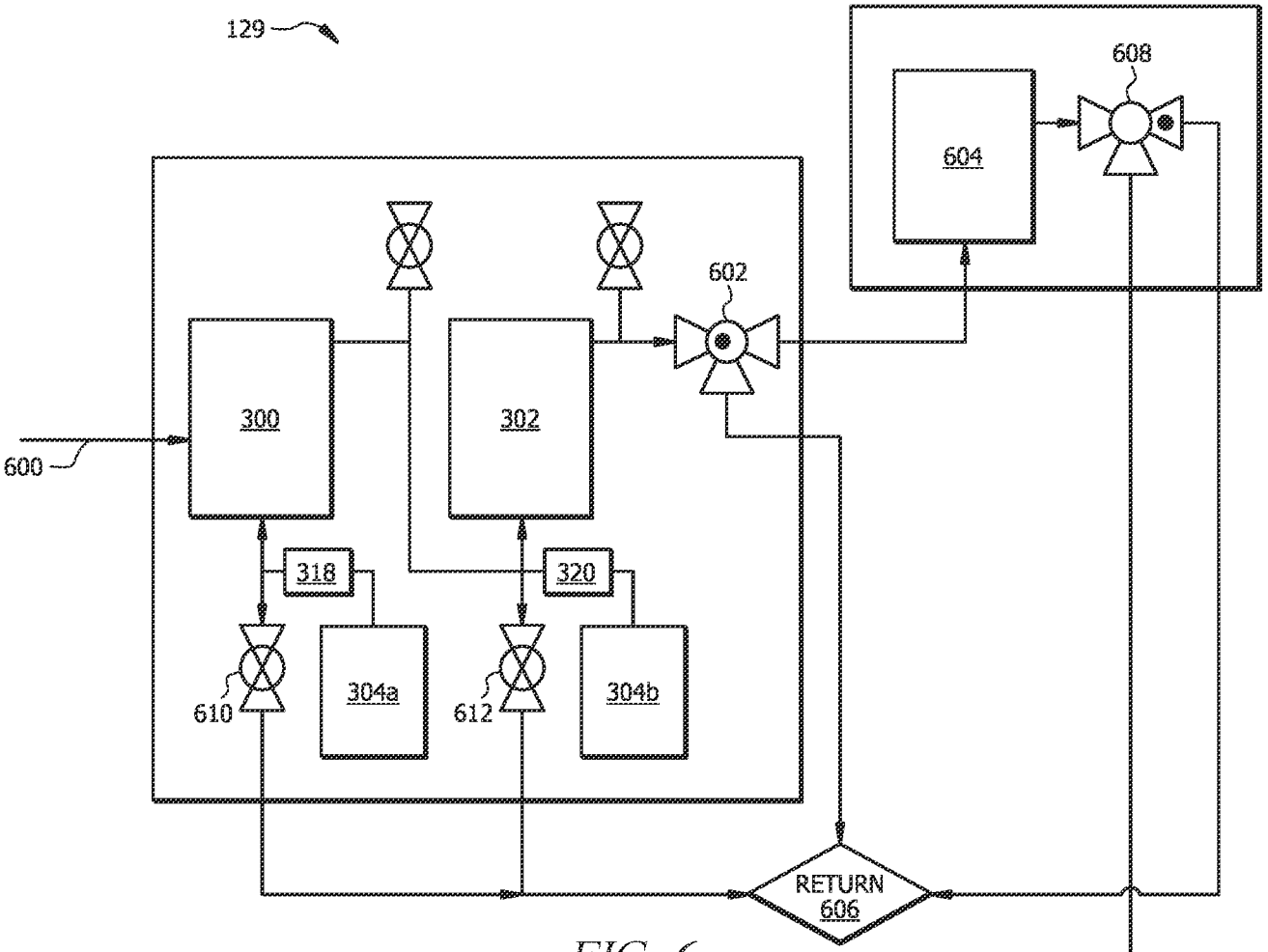
FIG. 6 is a diagram illustrating operation of the heater system of FIG. 3, according to one or more aspects of the present disclosure.

FIG. 6 is a diagram illustrating operation of the heater system 129. In embodiments, a drilling fluid 600 may be introduced into the heater system 129. The drilling fluid 600 may have been discharged from a pump (for example, pump 120 in FIG. 1) and/or processed for measuring a parameter of the drilling fluid 600 prior to introduction into the heater system 129. For example, a coriolis meter may have processed the drilling fluid 600 to determine a fluid flowrate, temperature, and/or density of the drilling fluid 600. Any other suitable sensors may be used to measure the drilling fluid during these operations. The drilling fluid 600 may flow through the fluid inlet 303 (referring to FIG. 4) of the first heater 300. The first heater 300 may be actuated to operate and increase a temperature of the drilling fluid 600 within the first heater 300. The first heater 300 may then discharge the drilling fluid 600 at an increased temperature through the fluid outlet 305 (referring to FIG. 4) to flow to the second heater 302. The discharged drilling fluid 600 may be introduced into the second heater 302 through the fluid inlet 303 and discharged at a greater temperature through the fluid outlet 305. The discharged drilling fluid 600 may then flow to a first valve 602 disposed between the second heater 302 and a degasser 604. The first valve 602 may be operable to direct the discharged drilling fluid 600 to the degasser 604 or to a return point 606 in a flow path of the drilling system 100 (referring to FIG. 1). In embodiments, the degasser 604 may be a device operable to remove gases from the drilling fluid 600. After flowing to the degasser 604, the drilling fluid 600 may be discharged to a second valve 608. The second valve 608 may be operable to direct the discharged drilling fluid 600 to the return point 606 or to another point along the flow path of the drilling system 100.

In one or more embodiments, there may be particle settlement or caking along a bottom portion of each of the first heater 300 and second heater 302. To mitigate these issues, the control system 130 (referring to FIG. 2) may actuate at least one air agitation unit 304 (referring to FIG. 3) to introduce compressed air into the first heater 300 and second heater 302 to provide mixing and suspension of the particles so that they may be removed once the drilling fluid 600 is discharged. As illustrated, there may be a first air agitation unit 304*a* operable to facilitate mixing in the first heater 300 and a second air agitation unit 304*b* operable to facilitate mixing in the second heater 302. When the flow rate of the drilling fluid 600 drops below a specified threshold or when the internal temperature of heaters 300, 302 increase above a specified threshold, the air agitation units 304*a*, 304*b* may operate. The air agitation units 304*a*, 304*b* may operate under other conditions, such as periodically or when the heater system 129 is flushed for cleaning.

In embodiments, the first air agitation unit 304*a* may actuate to discharge a volume of compressed air towards the first heater 300. The compressed air may flow along the first flow line 314 (referring to FIG. 4), through the first check valve 318 (referring to FIG. 4), and into the first heater 300 to mix and suspend particles having settled within the first heater 300. The first heater 300 may then discharge a mixture comprising the drilling fluid 600 and the suspended particles from the first heater 300. The discharged mixture may be directed to the second heater 302 or to the return point 606 through a third valve 610 coupled to the fluid outlet 305 of the first heater 300. Similarly, the second air agitation unit 304*b* may actuate to discharge a volume of compressed air towards the second heater 302. The compressed air may flow along the second flow line 316 (referring to FIG. 4), through the second check valve 320 (referring to FIG. 4), and into the second heater 302 to mix and suspend particles having settled within the second heater 302. The second heater 302 may then discharge a mixture comprising the drilling fluid 600 and the suspended particles from the second heater 302. The discharged mixture may be directed to the return point 606 through a fourth valve 612 coupled to the fluid outlet 305 of the second heater 300 or through the first valve 602.

In one or more embodiments, the heater system 129 may further comprise the first acoustic device 306 and the second acoustic device 308. The addition of first acoustic device 306 and the second acoustic device 308 may add energy to the heater 129 system to maintain suspension of the particles and remove build-up on coils within the heaters 300, 302, thereby increasing performance of the heaters 300, 302. In embodiments, the first acoustic device 306 and the second acoustic device 308 may be actuated in addition to or in place of the air agitation units 304*a*, 304*b*.

To facilitate a better understanding of the present disclosure, the following examples of certain aspects of certain embodiments are given. The following examples are not the only examples that could be given according to the present disclosure and are not intended to limit the scope of the disclosure or claims.

Example 1

Figure 7A:
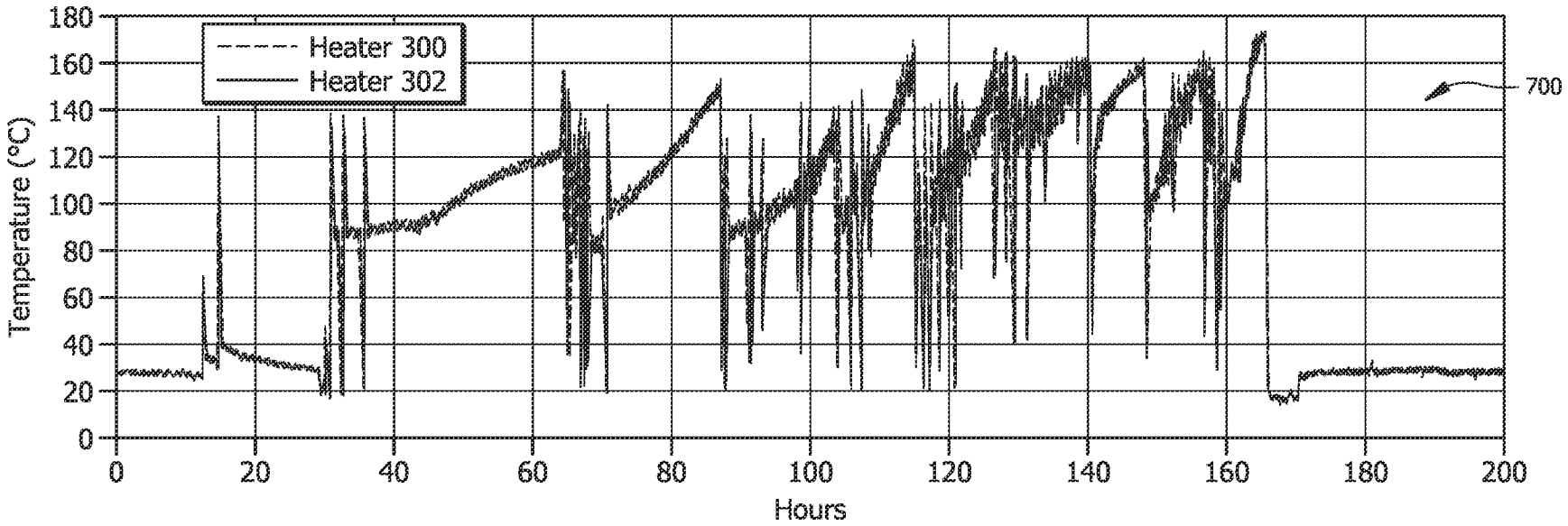
FIGS. 7A and 7B are graphs illustrating operation of the heater system of FIG. 3, according to one or more aspects of the present disclosure.

FIG. 7A illustrates a graph 700 depicting internal temperature (C°) for first heater 300 and second heater 302 as a function of time (hrs). Graph 700 illustrates an older heater system 129 (referring to FIG. 1) experiencing issues with particle settlement. For example, the graph 700 shows the sudden increases and drops in temperature. These events may be due to caking and/or particle settlement interfering with operations of the heater system 129. The temperature may increase suddenly then drop as a result of turning of the first heater 300 and second heater 302 for cleaning to remove the particle settlement.

Example 2

Figure 7B:
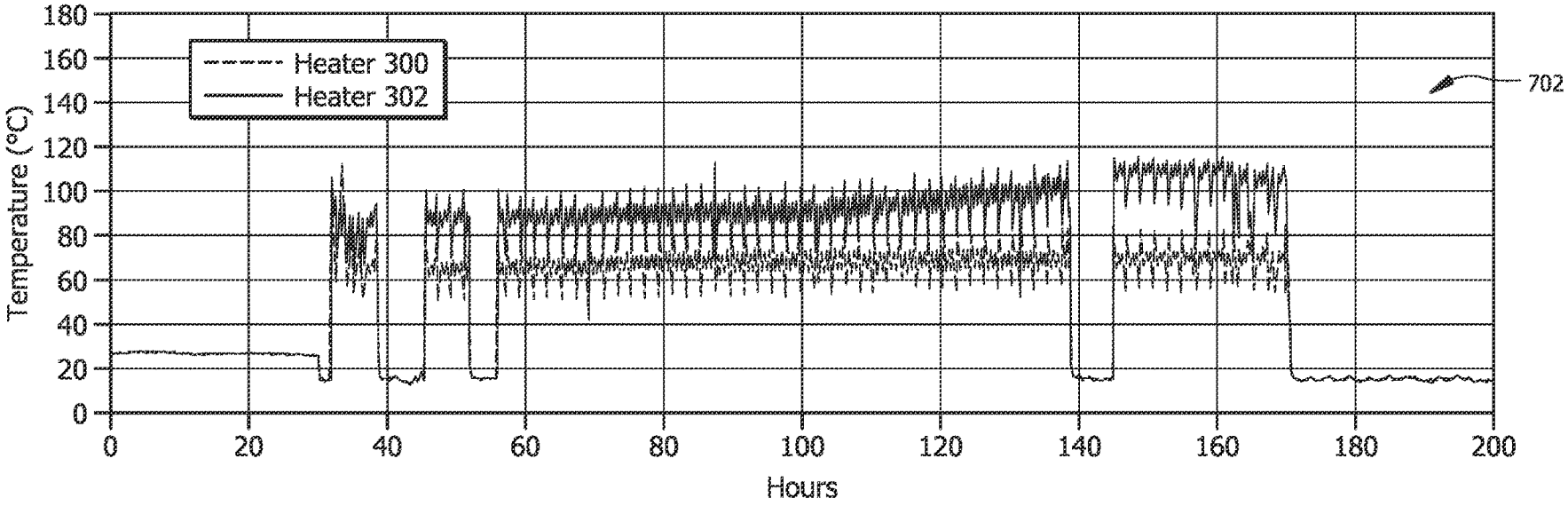

FIG. 7B illustrates a graph 702 depicting internal temperature (C°) for first heater 300 and second heater 302 as a function of time (hrs). Graph 702 illustrates an embodiment of the disclosed heater system 129 (referring to FIG. 1) with at least one air agitation unit 304 (referring to FIG. 3). For example, the graph 702 shows the steady maintenance of the internal temperature in both the first heater 300 and second heater 302. The smaller fluctuations may be representative of actuation of the air agitation unit 304 to introduce compressed air to mix and suspend particles having settled in the first and second heaters 300, 302.

An embodiment of the present disclosure is a method of removing particle settlement from a heater system, comprising: introducing a fluid into a first heater of the heater system, wherein the first heater is operable to increase the temperature of the introduced fluid; actuating a first air agitation unit to discharge a volume of compressed air into the first heater, wherein the compressed air is configured to provide mixing and suspension to particles settled within the first heater through the velocity and expansion of the compressed air to atmospheric pressure; discharging a mixture from the first heater comprising the fluid and the particles from the first heater; and directing the discharged mixture to a return point in a flow path.

In one or more embodiments described in the preceding paragraph, further comprising actuating a valve disposed between the first heater and a degasser to divert the discharged mixture to the return point. In one or more embodiments described above, further comprising introducing the discharged volume of the compressed air through a flow line coupling the first air agitation unit to a bottom end of the first heater. In one or more embodiments described above, further comprising introducing the discharged mixture into a second heater fluidly coupled to the first heater. In one or more embodiments described above, further comprising actuating a second air agitation unit to discharge a volume of compressed air into the second heater to provide mixing and suspension to particles settled within the second heater; and discharging a mixture from the second heater comprising the fluid, the particles from the first heater, and the particles from the second heater. In one or more embodiments described above, further comprising introducing the discharged volume of the compressed air through a flow line coupling the second air agitation unit to a bottom end of the second heater. In one or more embodiments described above, further comprising actuating a valve disposed between the second heater and a degasser to divert the discharged mixture to the return point.

Another embodiment of the present disclosure is a non-transitory computer-readable medium comprising instructions that are configured, when executed by a processor, to: introduce a fluid into a first heater of a heater system, wherein the first heater is operable to increase the temperature of the introduced fluid; actuate a first air agitation unit to discharge a volume of compressed air into the first heater, wherein the compressed air is configured to provide mixing and suspension to particles settled within the first heater through the velocity and expansion of the compressed air to atmospheric pressure; discharge a mixture from the first heater comprising the fluid and the particles from the first heater; and direct the discharged mixture to a return point in a flow path.

In one or more embodiments described in the preceding paragraph, wherein the instructions are further configured to: actuate a valve disposed between the first heater and a degasser to divert the discharged mixture to the return point. In one or more embodiments described above, wherein the instructions are further configured to: introduce the discharged volume of the compressed air through a flow line coupling the first air agitation unit to a bottom end of the first heater. In one or more embodiments described above, wherein the instructions are further configured to: introduce the discharged mixture into a second heater fluidly coupled to the first heater. In one or more embodiments described above, wherein the instructions are further configured to: actuate a second air agitation unit to discharge a volume of compressed air into the second heater to provide mixing and suspension to particles settled within the second heater; and discharge a mixture from the second heater comprising the fluid, the particles from the first heater, and the particles from the second heater. In one or more embodiments described above, wherein the instructions are further configured to: introduce the discharged volume of the compressed air through a flow line coupling the second air agitation unit to a bottom end of the second heater. In one or more embodiments described above, wherein the instructions are further configured to: actuate a valve disposed between the second heater and a degasser to divert the discharged mixture to the return point.

A further embodiment of the present disclosure is a system for removing particle settlement, comprising: a heater system comprising: a first heater; a second heater disposed downstream of the first heater; and a degasser disposed downstream of the second heater; a first air agitation unit coupled to the first heater; a second air agitation unit coupled to the second heater; and a control system comprising: a memory operable to store instructions executable by a processor; and the processor operable to: introduce a fluid into the first heater of the heater system, wherein the first heater is operable to increase the temperature of the introduced fluid; actuate the first air agitation unit to discharge a volume of compressed air into the first heater, wherein the compressed air is configured to provide mixing and suspension to particles settled within the first heater through the velocity and expansion of the compressed air to atmospheric pressure; discharge a mixture from the first heater comprising the fluid and the particles from the first heater; and direct the discharged mixture to a return point in a flow path.

In one or more embodiments described in the preceding paragraph, further comprising a flow line coupling the first air agitation unit to a bottom end of the first heater. In one or more embodiments described above, further comprising a flow line coupling the second air agitation unit to a bottom end of the second heater. In one or more embodiments described above, further comprising a valve disposed between the second heater and the degasser operable to divert the discharged mixture to the return point. In one or more embodiments described above, wherein the processor is further operable to actuate the first air agitation unit and the second air agitation unit to discharge the volume of compressed air periodically for a burst of about 5 seconds. In one or more embodiments described above, wherein the volume of compressed air is discharged at a pressure of from about 10 psi to about 30 psi.

Unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method of removing particle settlement from a heater system, comprising:

introducing a fluid into a first heater of the heater system;

actuating a first air agitation unit to generate a volume of compressed air and discharge the volume of compressed air into the first heater to provide mixing and suspension to particles settled within the first heater through the velocity and expansion of the compressed air to atmospheric pressure;

discharging from the first heater a discharged mixture comprising the fluid and the particles from the first heater; and directing the discharged mixture to a return point in a flow path.

2. The method of claim 1, further comprising actuating a valve disposed between the first heater and a degasser to divert the discharged mixture to the return point.

3. The method of claim 1, further comprising introducing the discharged volume of compressed air through a flow line coupling the first air agitation unit to a bottom end of the first heater.

4. The method of claim 1, further comprising introducing the discharged mixture into a second heater fluidly coupled to the first heater.

5. The method of claim 4, further comprising:

actuating a second air agitation unit to generate a second volume of compressed air and discharge the second volume of compressed air into the second heater to provide mixing and suspension to particles settled within the second heater; and discharging from the second heater a second discharged mixture comprising the fluid and the particles from the second heater.

6. The method of claim 5, further comprising introducing the second volume of the compressed air through a flow line coupling the second air agitation unit to a bottom end of the second heater.

7. The method of claim 6, further comprising actuating a valve disposed between the second heater and a degasser to divert the second discharged mixture to the return point.

8. A non-transitory computer-readable medium comprising instructions that are configured, when executed by a processor, to:

introduce a fluid into a first heater of a heater system;

actuate a first air agitation unit to generate a volume of compressed air and discharge the volume of compressed air into the first heater to provide mixing and suspension to particles settled within the first heater through the velocity and expansion of the compressed air to atmospheric pressure;

discharge from the first heater a discharged mixture comprising the fluid and the particles from the first heater; and direct the discharged mixture to a return point in a flow path.

9. The non-transitory computer-readable medium of claim 8, wherein the instructions are further configured to:

actuate a valve disposed between the first heater and a degasser to divert the discharged mixture to the return point.

10. The non-transitory computer-readable medium of claim 8, wherein the instructions are further configured to:

introduce the discharged volume of compressed air through a flow line coupling the first air agitation unit to a bottom end of the first heater.

11. The non-transitory computer-readable medium of claim 8, wherein the instructions are further configured to:

introduce the discharged mixture into a second heater fluidly coupled to the first heater.

12. The non-transitory computer-readable medium of claim 11, wherein the instructions are further configured to:

actuate a second air agitation unit to generate a second volume of compressed air and discharge the volume of compressed air into the second heater to provide mixing and suspension to particles settled within the second heater; and discharge from the second heater a second discharged mixture comprising the fluid, the particles from the first heater, and the particles from the second heater.

13. The non-transitory computer-readable medium of claim 12, wherein the instructions are further configured to: introduce the discharged volume of compressed air through a flow line coupling the second air agitation unit to a bottom end of the second heater.

14. The non-transitory computer-readable medium of claim 13, wherein the instructions are further configured to: actuate a valve disposed between the second heater and a degasser to divert the second discharged mixture to the return point.

* * * * *